US012102930B1

(12) United States Patent
Shi

(10) Patent No.: US 12,102,930 B1
(45) Date of Patent: Oct. 1, 2024

(54) BALL PITCHING DEVICE

(71) Applicant: Dongguan Hongyu Plastic Co., Ltd., Guangdong (CN)

(72) Inventor: Juying Shi, Guangdong (CN)

(73) Assignee: Dongguan Hongyu Plastic Co., Ltd., Dongguan (CN)

( * ) Notice: Subject to any disclaimer, the term of this patent is extended or adjusted under 35 U.S.C. 154(b) by 0 days.

(21) Appl. No.: 18/735,410

(22) Filed: Jun. 6, 2024

(30) Foreign Application Priority Data

Apr. 12, 2024 (CN) ..... 202420763654.9

(51) Int. Cl.

| | |
|---|---|
| ***A63F 7/36*** | (2006.01) |
| ***A63F 7/00*** | (2006.01) |
| ***A63F 7/34*** | (2006.01) |
| *A63F 7/30* | (2006.01) |

(52) U.S. Cl.

CPC ..... *A63F 7/0005* (2013.01); *A63F 7/34* (2013.01); *A63F 7/36* (2013.01); *A63F 2007/0011* (2013.01); *A63F 2007/302* (2013.01); *A63F 2007/345* (2013.01); *A63F 2007/3655* (2013.01); *A63F 2007/3696* (2013.01)

(58) Field of Classification Search

CPC .. A63F 7/0005; A63F 7/34; A63F 7/36; A63F 2007/0011; A63F 2007/3655; A63F 2007/302; A63F 2007/3696; A63F 2007/345

See application file for complete search history.

(56) References Cited

U.S. PATENT DOCUMENTS

| | | | | | |
|---|---|---|---|---|---|
| 718,709 | A * | 1/1903 | De Grandchamp | .. | A63F 7/0005 273/126 R |
| 1,531,880 | A * | 3/1925 | Ritter | ..... | A63F 7/0005 273/352 |
| 2,926,915 | A * | 3/1960 | Johns | ..... | A63F 7/0058 273/118 A |
| 3,825,264 | A * | 7/1974 | Dockum | ..... | A63F 7/0005 473/107 |
| 4,995,611 | A * | 2/1991 | Goldthorpe | ..... | A63F 7/36 108/62 |

(Continued)

FOREIGN PATENT DOCUMENTS

| | | | | | |
|---|---|---|---|---|---|
| CN | 108434720 | A * | 8/2018 | ..... | A63F 7/0616 |
| GB | 2483920 | A * | 3/2012 | ..... | A63D 15/00 |
| WO | WO-2022115532 | A2 * | 6/2022 | ..... | A63B 67/06 |

*Primary Examiner* — Raleigh W Chiu
(74) *Attorney, Agent, or Firm* — Cooper Legal Group, LLC

(57) ABSTRACT

A ball pitching device includes a frame including three first elbows and four second elbows, an upper PVC sheet and a lower PVC sheet below the upper PVC sheet and connected with the upper PVC sheet, the upper PVC sheet is connected with the frame, a ball storage space is formed between the lower PVC sheet and the upper PVC sheet, the upper PVC sheet is configured with a hole, the three first elbows are connected in sequence, two adjacent first elbows are arranged horizontally and hinged to each other, the remaining first elbow extends obliquely and is hinged to the two horizontal first elbows, two second elbows are respectively hinged with the two horizontal first elbows at two ends of the frame, another second elbow is hinged at a connection between the two horizontal first elbows, and the remaining second elbow is hinged to the oblique first elbow.

10 Claims, 4 Drawing Sheets

(56) References Cited

U.S. PATENT DOCUMENTS

| | | | | |
|---|---|---|---|---|
| 2002/0098896 | A1* | 7/2002 | Rieber | A63D 15/04<br>473/10 |
| 2005/0206084 | A1* | 9/2005 | Krouse | A63F 7/0058<br>273/352 |
| 2022/0241677 | A1* | 8/2022 | Wasserman | A63B 67/06 |

* cited by examiner

BALL PITCHING DEVICE

CROSS-REFERENCE TO RELATED APPLICATION

The present application is based on and claims the priority benefits of China application No. 202420763654.9, filed on Apr. 12, 2024. The entirety of China application No. 202420763654.9 is hereby incorporated by reference herein and made a part of this specification.

TECHNICAL FIELD

The present application relates to a technical field of pitching devices, and, more particularly, to a ball pitching device.

BACKGROUND ART

Ball pitching is a simple entertainment game. Players pitch balls into different holes to score points, and the one with the highest score wins. Since multiple holes for players to pitch and mechanisms for collecting the balls that enter the holes are required, a ball pitching device occupies a certain space. The existing ball pitching devices cannot be stored when not in use, which brings inconvenience to users.

SUMMARY

In order to improve the storage convenience of a ball pitching device, the present application provides a ball pitching device.

The ball pitching device provided by the present application adopts the following technical solution.

The ball pitching device includes a frame, an upper PVC sheet and a lower PVC sheet, the upper PVC sheet is connected with the frame, the lower PVC sheet is located below the upper PVC sheet, the lower PVC sheet is connected with the upper PVC sheet, a ball storage space is formed between the lower PVC sheet and the upper PVC sheet, the upper PVC sheet is configured with a hole, the frame includes three first elbows and four second elbows, the three first elbows are connected in sequence, two adjacent first elbows of the three first elbows are arranged horizontally and hinged to each other, and a remaining one of the three first elbows extends obliquely and is hinged to one of the two horizontal first elbows, two of the four second elbows are respectively hinged with the two horizontal first elbows at two ends of the frame, another one of the four second elbows is hinged at a connection between the two horizontal first elbows, and a remaining one of the four second elbows is hinged to the oblique first elbow.

By adopting the above technical solution, when the ball pitching device is lying idle, the second elbows are rotated, so that each of the second elbows abuts against a corresponding first elbow, and then the first elbows rotated, so that the first elbows are stacked correspondingly, thereby reducing the space occupancy of the frame in whole, such that it is easy to fold and store the device when not in use.

Optionally, connection sockets are provided between each two adjacent first elbows of the three first elbows and between each of the three first elbows and a respective one of the four second elbows, and each of the connection sockets is hinged to a respective one of the three first elbows or a respective one of the four second elbows through a pin.

By adopting the above technical solution, with the connection sockets and the pins, the stability of the device may be increased, the fixation effect of the pin may ensure the firm connection between the connection socket and the first elbow or the second elbow, thereby reducing the possibility of shaking and loosening, thus improving the stability of the device.

Optionally, a support rod is provided between one of the four second elbows and the oblique first elbow, a first end of the support rod is hinged to the oblique first elbow, and a second end of the support rod is detachably connected to the one of the four second elbows.

By adopting the above technical solution, with the support rod, the stability of the whole device may be increased. The support rod provides an additional support, such that the second elbow may be more stably connected with the oblique first elbow. At the same time, by changing the position of the hinge point between the support rod and the first elbow, or by choosing the support rods of different lengths, the inclination angle can be adjusted, such that the inclination degree can be self-defined according to needs, to adapt to different usage scenarios or personal preferences.

Optionally, a side wall of the one of the four second elbows is fixedly provided with a limit block, the support rod is configured with a plurality of limit openings at intervals along a length direction of the support rod, and the limit block is configured to be snapped into one of the plurality of limit openings.

By adopting the above technical solution, through the cooperation of the limiting opening and the limit block, the support rod can be firmly fixed at a selected position. Since there are a plurality of limit openings, the inclination angle of the support rod can be adjusted for many times as needed. By selecting different limit openings, the angle between the support rod and the first elbow and the second elbow can be changed, thereby adjusting the inclination degree, to adapt to different usage scenarios and angle requirements.

Optionally, each of the four second elbows is fixedly provided with a foot brace, and the foot brace is configured for contacting with a ground.

By adopting the above technical solution, an additional stable support is provided, making the entire ball pitching device more stable during use. The foot brace can disperse the weight of the device through the contact with the ground, which increases the support area, thereby improving the stability of the device and preventing it from shaking or inclining during use.

Optionally, a plurality of holes are provided in an array, an inner side of each of the plurality of holes is provided with an infrared sensor, a screen displaying score is provided on the one of the four second elbows, and the screen displaying score is connected with the infrared sensor.

By adopting the above technical solution, when a player pitches a ball into a hole, the infrared sensor will detect the entry of the ball. The infrared sensor may detect the presence of the ball or determine whether the ball enters the hole by change of light. Once the infrared sensor detects the entry of the ball, the infrared sensor will send a signal to the connected screen displaying score, which receives the signal from the infrared sensor and records a corresponding score on the screen displaying score.

Optionally, the ball pitching device further includes two side nets, the two side nets are respectively located on two sides of the frame, each of the two side nets is provided with buckles, and the buckles are configured to be snapped into the connection sockets.

By adopting the above technical solution, two side nets may intercept the balls that bounce to outside of the device due to collision, so as to prevent the balls from rolling out of the device range, which allows users to focus more on the game without concerning about loss of the balls or the impact of the balls on other objects.

Optionally, the pitching device further includes a collection basket, the collection basket is arranged at a tail end of the two ends of the frame, the collection basket includes a basket body and a mesh cloth, the basket body is installed on the frame, the mesh cloth is fixed on a side wall of the basket body, and the mesh cloth and the basket body are enclosed to form the collection basket opened upwards.

By adopting the above technical solution, when the balls enter the device but do not enter the holes, they will be guided to a rear collection basket. By the basket body and the mesh cloth, the collection basket can effectively hold the balls, so as to prevent the balls from rolling out of the device and reducing the loss of the balls.

Optionally, the lower PVC sheet extends obliquely from an end facing the plurality of holes towards an end facing the collection basket.

By adopting the above technical solution, the lower PVC sheet 3 is inclined towards the end thereof facing the holes 21, such that the balls may be guided to roll downward along an inclined surface and move towards the end facing the collection basket 5, making the balls smoothly roll into the collection basket 5, which improves the accuracy and reliability of the balls entering the collection basket.

Optionally, a surface of the upper PVC sheet is fixedly provided with a fence, and the fence surrounds the plurality of holes.

By adopting the above technical solution, the ball may enter the hole enclosed by the fence due to the guidance of the fence, thereby improving the field goal percentage of the ball and indirectly improving the user experience.

In summary, the present application includes at least one of the following beneficial technical effects.

1. The space occupancy of the frame in whole is reduced, such that it is easy to fold and store the device when not in use.
2. The balls are effectively held in the collection basket, thereby preventing the balls from rolling out of the device and reducing the loss of the balls.
3. The balls can enter the holes enclosed by the fence, which improves the field goal percentage of the balls and indirectly improves the user experience.

DETAILED DESCRIPTION

The present application will be further described in detail below with reference to FIGS. 1-4.

Figure 1:
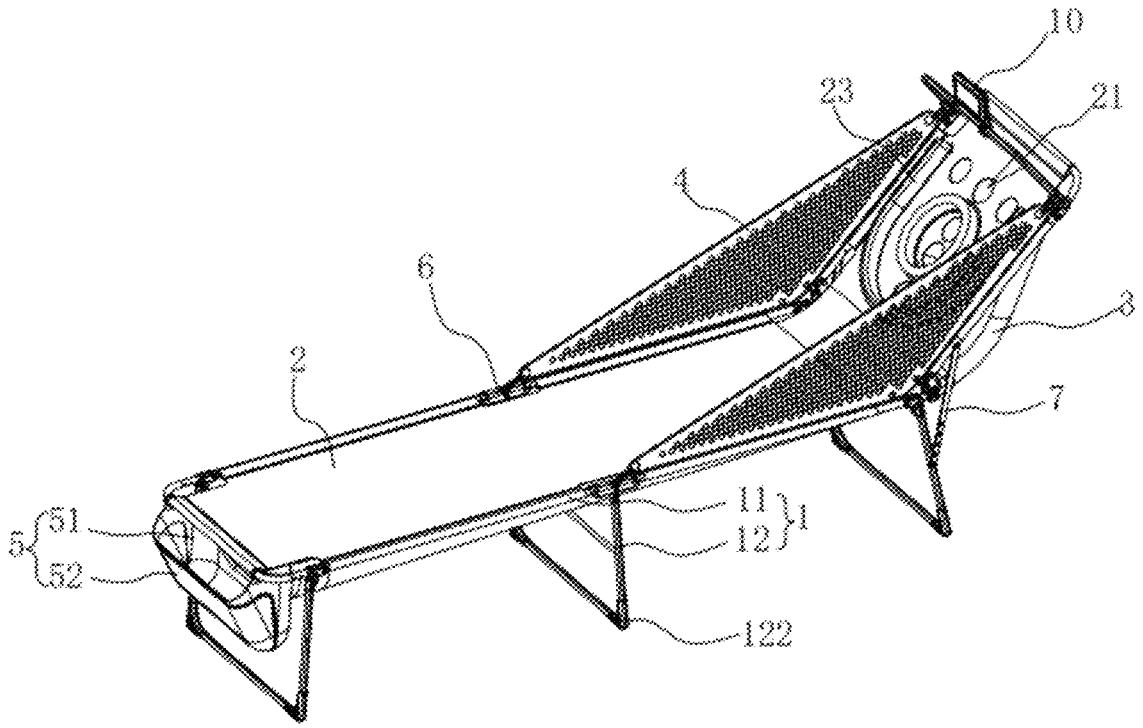
FIG. 1 is a schematic view showing the overall structure of a ball pitching device in the embodiment of the present application.

The embodiment of the present application discloses a ball pitching device. Referring to FIG. 1, the ball pitching device includes a frame 1, an upper PVC sheet 2, a lower PVC sheet 3, a side net 4 and a collection basket 5, the frame 1 is configured to support the upper PVC sheet 2, the lower PVC sheet 3, the side net 4 and the collection basket 5, and the frame 1 is foldable, the upper PVC sheet 2 is combined with the lower PVC sheet 3 to achieve a pitching function, the side net 4 is configured to prevent a ball from popping out to outside, and the collection basket 5 is configured to collect the ball after being pitched.

Figure 2:
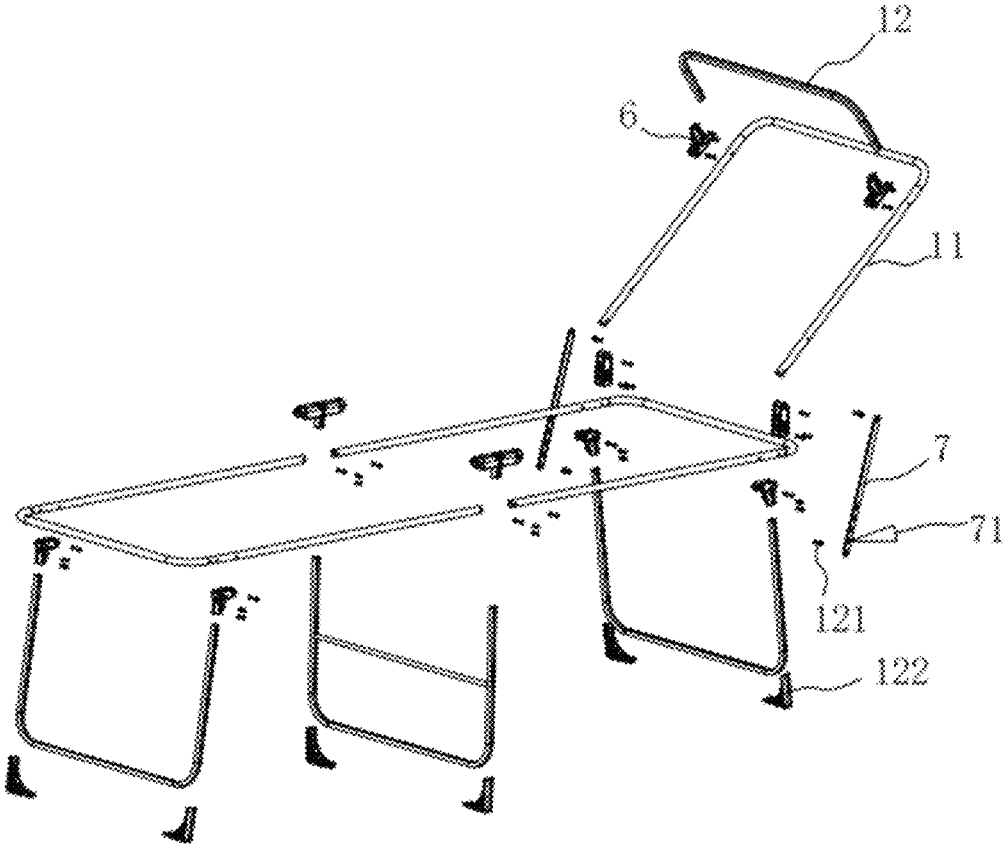
FIG. 2 is an exploded view of a frame in the embodiment of the present application.
Figure 3:
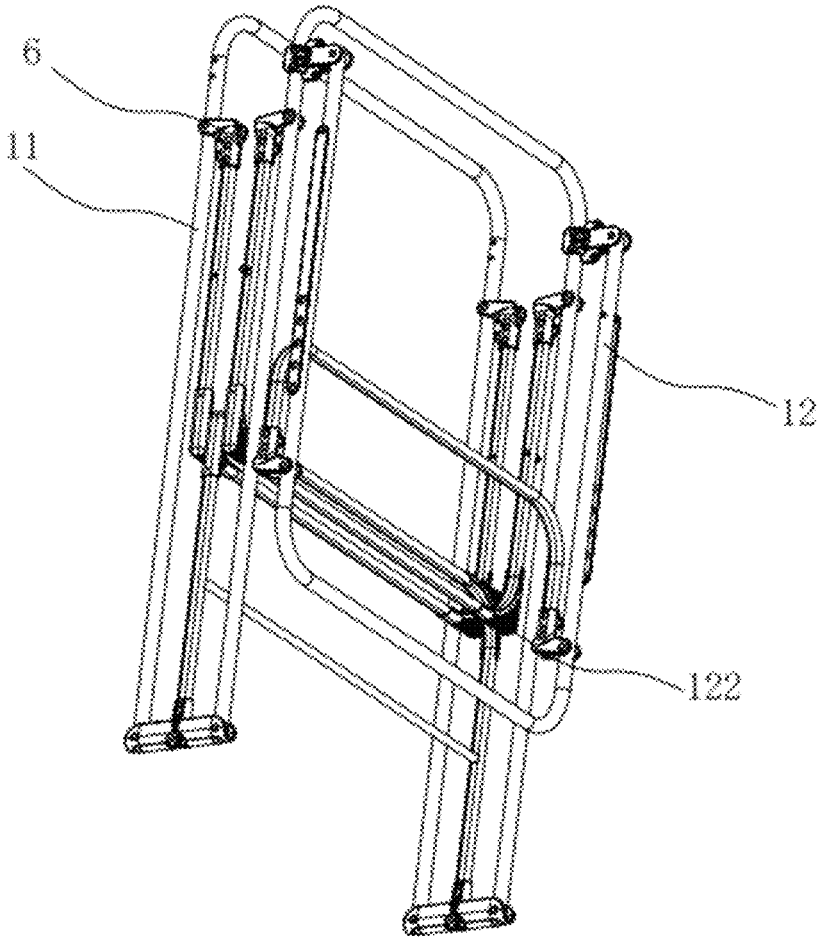
FIG. 3 is a view showing the structure of the folded frame in the embodiment of the present application.

Referring to FIGS. 2 and 3, specifically when the frame 1 unfolded, for example, the frame 1 includes three first elbows 11 and four second elbows 12. The first elbows 11 and the second elbows 12 are all U-shaped. The three first elbows 11 are connected in sequence, in which two adjacent first elbows 11 are horizontally arranged, ends of the two first elbows 11 are facing each other and hinged to each other. In addition, the other first elbow 11 extends obliquely, and two ends of the oblique first elbow 11 are hinged to one of the horizontal first elbows 11. The oblique first elbow 11 extends obliquely upwards and away from the horizontal first elbow 11, to which the oblique first elbow is hinged.

Further, two of the four second elbows 12 are respectively hinged to the two horizontal first elbows 11, specifically, ends of the two second elbows 12 are hinged to the two horizontal first elbows 11, correspondingly. The two second elbows 12 are located at the front and rear ends of the frame 1, respectively. At the same time, another second elbow 12 is hinged at a connection between the two horizontal first elbows 11, that is, the another second elbow 12 is located between the two second elbows 12 mentioned above, and the remaining second elbow 12 is hinged to the oblique first elbow 11.

Therefore, when the ball pitching device is lying idle, the second elbows 12 may be rotated, so that each second elbow 12 abuts against the corresponding first elbow 11, respectively, and then the first elbows 11 are rotated, so that the first elbows 11 are stacked correspondingly, thereby reducing the space occupancy of the whole frame 1, making the device easy to fold and store when not in use.

Specifically, connection sockets 6 are provided between two adjacent first elbows 11 and between the first elbow 11 and the second elbow 12, respectively, and the connection socket 6 is hinged to the first elbow 11 or the second elbow 12 through pins. The connection sockets 6 between the two adjacent horizontal first elbows 11 are T-shaped connection elements, each of which has three connection ends, two of the three connection ends are hinged to the two horizontal first elbows 11 through corresponding pins, and the other connection end is configured to be hinged to one of the second elbows 12. In addition, the connection sockets 6 between the oblique first elbow 11 and any one of the horizontal first elbows 11 are L-shaped connection elements, and similarly, the connection sockets 6 between the second elbows 12 and the first elbows 11 are also L-shaped connection elements.

Therefore, by means of the connection sockets 6 and the pins, the stability of the device can be increased, the fixation effect of the pin can ensure the firm connection between the connection socket 6 and the first elbow 11 or the second elbow 12, reducing the possibility of shaking and loosening, thereby improving the stability of the device. In addition, by means of the connection sockets 6 and the pins, different parts of the device can be conveniently disassembled and maintained. If it is necessary to make reparation or replacement, relevant parts can be easily separated by detaching the pin, to carry out the necessary reparation or replacement.

On the other hand, in order to improve the stability of the oblique first elbow 11, the present application further adopts the following solution.

Specifically, a support rod 7 is provided between one of the second elbows 12 and the oblique first elbow 11, one end of the support rod 7 is hinged to the oblique first elbow 11, and the other end of the support rod 7 is detachably connected to the one of the second elbows 12.

Correspondingly, by means of the support rod 7, the stability of the whole device may be increased, which provides an additional support, such that the second elbow 12 is more firmly connected with the oblique first elbow 11. At the same time, the position of the hinge point between the support rod 7 and the oblique first elbow 11 is modified, or the support rods 7 of different lengths are chosen, such that the inclination angle can be adjusted, and the inclination degree can be self-defined according to needs, to adapt to different usage scenarios or personal preferences.

Further, a side wall of the second elbow 12 is fixedly provided with a limit block 121, and the support rod 7 is configured with a plurality of limit openings 71 at intervals along its own length direction, and the limit block 121 is engaged with one of the limit openings 71.

Therefore, the limit opening 71 is engaged with the limit block 121, such that the support rod 7 can be firmly fixed at a selected position. Since there are a plurality of limit openings 71, the angle of the support rod 7 can be adjusted many times as needed. By selecting different limit openings 71, the angle between the support rod 7 and the oblique first elbow 11 and the second elbow 12 can be changed, thereby adjusting the inclination degree, to adapt to different usage scenarios and angle requirements.

Further, the second elbow 12 is fixedly provided with a foot brace 122, which is configured for contacting with the ground. The foot brace provides an additional stable support, making the entire ball pitching device more stable during use. The foot brace 122 may disperse the weight of the device and increase the support area due to the contact with the ground, thereby improving the stability of the device and preventing it from shaking or inclining during use.

Figure 4:
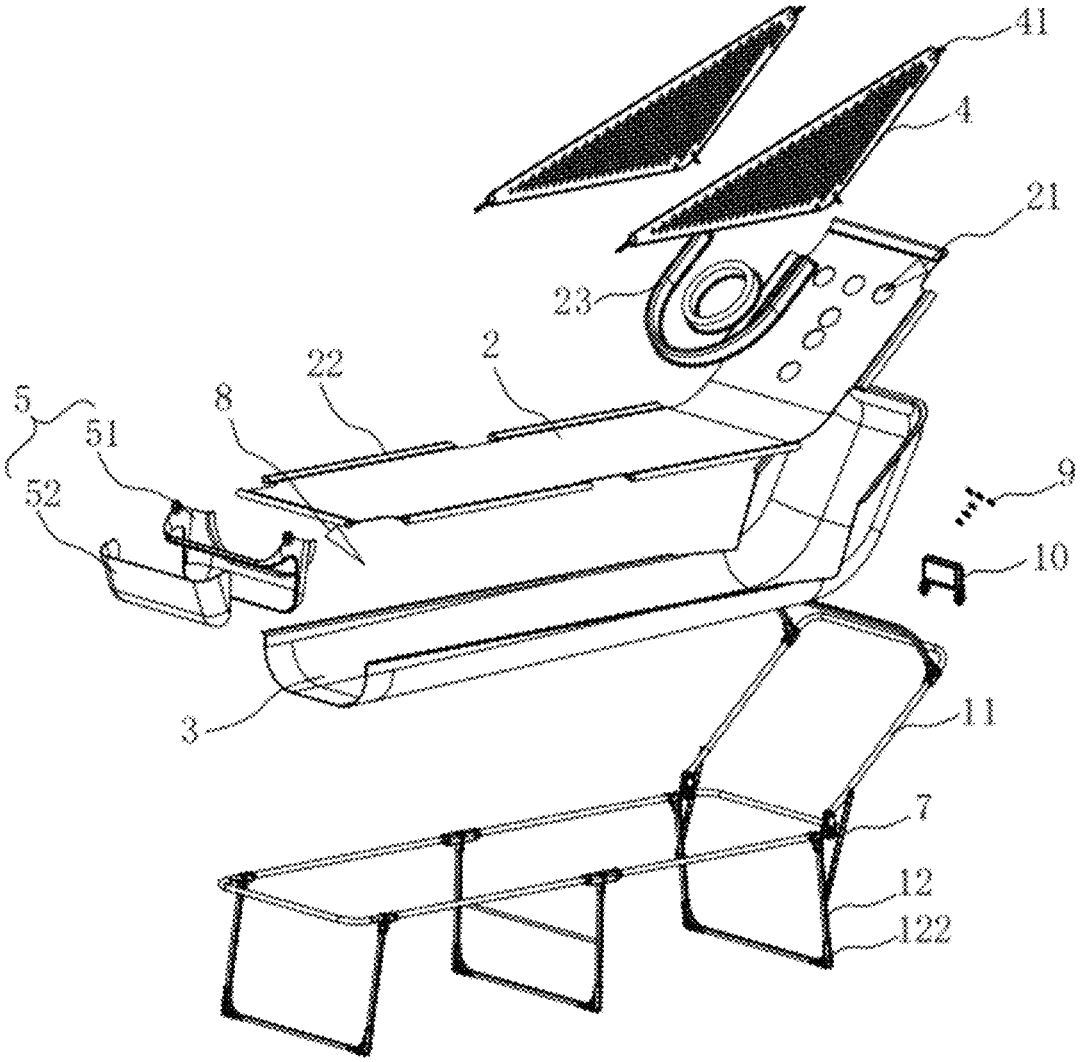
FIG. 4 is an exploded view of the ball pitching device in the embodiment of the present application.

Referring to FIGS. 1 and 4, on the other hand, an edge of the upper PVC sheet 2 is provided with a sleeve 22, two ends of the sleeve 22 are open. The first elbow 11 extends through the sleeve 22, to achieve the fixation between the upper PVC sheet 2 and the frame 1. At the same time, the upper PVC sheet 2 is configured with a hole 21. In the embodiment, six holes 21 are provided, three of which are arranged horizontally at intervals, and the other three holes are arranged vertically at intervals. In addition, the lower PVC sheet 3 is located below the upper PVC sheet 2, the lower PVC sheet 3 is fixedly connected with the upper PVC sheet 2. A ball storage space 8 is formed between the lower PVC sheet 3 and the upper PVC sheet 2. That is, after the ball passes through the hole 21, it enters the ball storage space 8 and is held by the lower PVC sheet 3.

Correspondingly, when the upper PVC sheet 2 is connected with the first elbow 11, a part of the upper PVC sheet 2 extends horizontally while the other part of the upper PVC sheet 2 extends obliquely since one of the first elbows 11 extends obliquely, and the holes 21 are correspondingly defined in the oblique part.

Further, for the fun of the device, an infrared sensor 9 is provided inside the hole 21, which is fixed relative to the lower PVC sheet 3. A screen displaying score 10 is provided on the second elbow 12, which is connected with the infrared sensor 9.

When a player pitches a ball into the hole 21, the infrared sensor 9 will detect an entry of the ball. The sensor can detect a presence of the ball or determine whether the ball enters the hole 21 by change of light. Once the infrared sensor 9 detects the entry of the ball, the infrared sensor 9 will send a signal to the screen displaying score 10, which receives the signal from the infrared sensor 9 and records the corresponding score on the screen displaying score 10.

In addition, the surface of the upper PVC sheet 2 is fixedly provided with a fence 23, which is arranged around several holes 21. Specifically, two fences 23 are provided, one of the two fences 23 is circular, and the other fence 23 is U-shaped. One of the two fences 23 extends around the outside of the two holes 21 which are arranged vertically, and the other fence 23 is located below the previous fence 23.

Therefore, the ball may enter the hole 21 enclosed by the fence 23 due to the guidance of the fence 23, thereby improving the field goal percentage of the ball and indirectly improving the user experience.

On the other hand, in order to improve the user experience during pitching, a side net 4 is correspondingly provided in the embodiment of the present application.

Specifically, two side nets 4 are provided, which are located on two sides of the frame 1. The side net 4 is provided with buckles 41, which are snapped into the connection sockets 6, such that the side nets 4 may block part of the space on the left side and right side of the upper PVC after the side nets 4 are erected.

Therefore, two side nets 4 may intercept the balls that bounce to outside of the device due to collision, so as to prevent the balls from rolling out of the device range, which allows users to focus more on the game without concerning about the loss of the balls or the impact of the balls on other objects.

Further, the collection basket 5 is provided at a tail end of the frame 1, which includes a basket body 51 and a mesh cloth 52. The basket body 51 is rotatably supported on the first elbow 11, and the mesh cloth 52 is fixed to a side wall of the basket body 51, the mesh cloth 52 and the basket body 51 are enclosed to form the collection basket 5 opened upwards. At the same time, the collection basket 5 is located on the open end of the ball storage space 8.

Therefore, when the balls enter the device but do not enter the holes 21, they will be guided to a rear collection basket 5. By the basket body 51 and the mesh cloth 52, the collection basket 5 can effectively hold the balls, so as to prevent the balls from rolling out of the device and reducing the loss of the balls.

At the same time, the mesh cloth 52 makes the collection basket 5 semi-transparent, such that it is easy for users to see the goals from a side.

Further, the lower PVC sheet 3 extends obliquely from an end facing the holes 21 towards an end facing the collection basket 5.

Therefore, the end of the lower PVC sheet 3 facing the holes 21 is inclined, such that the balls may be guided to roll downward along an inclined surface and move towards the end facing the collection basket 5, making the balls smoothly roll into the collection basket 5, which improves the accuracy and reliability of the balls entering the collection basket 5.

The implementation principle of the ball pitching device in the embodiment of the application is as follows.

When the ball pitching device is lying idle, the second elbows 12 are rotated, so that each second elbow 12 abuts against the corresponding first elbow 11, and then the first elbows 11 are rotated, so that the first elbows 11 are stacked correspondingly, thereby reducing the space occupancy of the frame 1 in whole, so as to fold and store the device conveniently when not in use.

The above are the preferred embodiments of the present application, which are not intended to limit the protection scope of the present application. Therefore, all equivalent changes made according to the structure, shape and principle of the present application should be covered within the protection scope of the present application.

LISTING OF REFERENCE SIGNS

1 frame
11 first elbow
12 second elbow
121 limit block
122 foot brace
2 upper PVC sheet
21 hole
22 sleeve
23 fence
3 lower PVC sheet
4 side net
41 buckle
5 collection basket
51 basket body
52 mesh cloth
6 connection socket
7 support rod
71 limit opening
8 ball storage space
9 infrared sensor
10 screen displaying score

What is claimed is:

1. A ball pitching device, comprising a frame, an upper polyvinyl chloride (PVC) sheet and a lower PVC sheet, wherein the upper PVC sheet is connected with the frame, the lower PVC sheet is located below the upper PVC sheet, the lower PVC sheet is connected with the upper PVC sheet, a ball storage space is formed between the lower PVC sheet and the upper PVC sheet, the upper PVC sheet is configured with a hole, wherein the frame comprises three first elbows and four second elbows, the three first elbows are connected in sequence, two adjacent ones of the three first elbows are arranged horizontally and hinged to each other, a remaining one of the three first elbows extends obliquely and is hinged to one of the two adjacent ones of the three first elbows arranged horizontally, wherein two of the four second elbows are respectively hinged with the two adjacent ones of the three first elbows arranged horizontally at two ends of the frame, another one of the four second elbows is hinged at a connection between the two adjacent ones of the three first elbows arranged horizontally, and a remaining one of the four second elbows is hinged to the remaining one of the three first elbows.

2. The ball pitching device according to claim 1, wherein connection sockets are provided between each two adjacent first elbows of the three first elbows and between each of the three first elbows and a respective one of the four second elbows, and each of the connection sockets is hinged to a respective one of the three first elbows or a respective one of the four second elbows through a pin.

3. The ball pitching device according to claim 1, wherein a support rod is provided between one of the four second elbows and the remaining one of the three first elbows, a first end of the support rod is hinged to the remaining one of the three first elbows, and a second end of the support rod is detachably connected to the one of the four second elbows.

4. The ball pitching device according to claim 3, wherein a side wall of the one of the four second elbows is fixedly provided with a limit block, the support rod is configured with a plurality of limit openings at intervals along a length direction of the support rod, and the limit block is configured to be snapped into one of the plurality of limit openings.

5. The ball pitching device according to claim 4, wherein each of the four second elbows is fixedly provided with a foot brace, and the foot brace is configured for contacting with a ground.

6. The ball pitching device according to claim 4, wherein a plurality of holes are provided in an array, an inner side of each of the plurality of holes is provided with an infrared sensor, a screen displaying score is provided on the one of the four second elbows, and the screen displaying score is connected with the infrared sensor.

7. The ball pitching device according to claim 6, further comprising two side nets, the two side nets are respectively located on two sides of the frame, each of the two side nets is provided with buckles, and the buckles are configured to be snapped into connection sockets.

8. The ball pitching device according to claim 7, further comprising a collection basket, the collection basket is arranged at a tail end of the two ends of the frame, the collection basket comprises a basket body and a mesh cloth, the basket body is installed on the frame, the mesh cloth is fixed on a side wall of the basket body, and the mesh cloth and the basket body are enclosed to form cause the collection basket to open upwards.

9. The ball pitching device according to claim 8, wherein the lower PVC sheet extends obliquely from an end facing the plurality of holes towards an end facing the collection basket.

10. The ball pitching device according to claim 9, wherein a surface of the upper PVC sheet is fixedly provided with a fence, and the fence surrounds the plurality of holes.

* * * * *